US005417255A

United States Patent [19]

Sanfilippo et al.

[11] Patent Number: 5,417,255

[45] Date of Patent: May 23, 1995

[54] GAS FLUSHING APPARATUS AND METHOD

[76] Inventors: James J. Sanfilippo, 505 N. Lake Shore Dr., 6806, Chicago, Ill. 60611; John E. Sanfilippo, P.O. Box 952, Barrington, Ill. 60011

[21] Appl. No.: 122,388

[22] Filed: Sep. 16, 1993

[51] Int. Cl.[6] ..... B65B 31/00

[52] U.S. Cl. ..... 141/1; 141/4; 141/64; 141/70; 141/11; 141/129; 141/91; 141/286; 53/87; 53/510; 53/432; 239/291; 239/590.3

[58] Field of Search ..... 141/4, 11, 63, 64, 67, 141/70, 236, 129, 131, 285, 286, 91, 92; 53/79, 86–89, 110, 403, 432, 510; 239/291, 553, 553.3, 575, 590.3, DIG. 23

[56] References Cited

U.S. PATENT DOCUMENTS

| | | | |
|---|---|---|---|
| 2,131,876 | 7/1936 | Hurst . | |
| 2,240,655 | 5/1941 | Kronquest . | |
| 2,362,799 | 11/1944 | Boyd et al. . | |
| 2,439,773 | 4/1948 | Hohl et al. | 53/510 |
| 2,519,353 | 8/1950 | Cassady . | |
| 2,521,746 | 9/1950 | Preis | 99/272 |
| 2,630,958 | 3/1953 | Hohl | 53/432 X |
| 2,660,352 | 11/1953 | Renard | 141/70 |
| 2,768,487 | 10/1956 | Day et al. . | |
| 3,347,534 | 10/1967 | Dawson . | |
| 3,415,310 | 12/1968 | Kuhlmann | 165/27 |
| 3,545,160 | 12/1970 | Jantze et al. . | |
| 3,860,047 | 1/1975 | Finkelmeier et al. | 141/47 |
| 3,871,157 | 3/1975 | Domke et al. | 53/110 |
| 3,881,300 | 5/1975 | Zetterberg . | |
| 3,942,301 | 3/1976 | Domke | 53/110 |
| 4,014,158 | 3/1977 | Rausing | 53/167 |
| 4,016,705 | 4/1977 | Wilson et al. . | |
| 4,027,450 | 6/1977 | Chiu et al. | 53/112 B |
| 4,094,121 | 6/1978 | Ganholt . | |
| 4,140,159 | 2/1979 | Domke | 141/129 |
| 4,588,000 | 5/1986 | Malin et al. | 141/129 X |
| 4,658,566 | 4/1987 | Sanfilippo et al. | 53/432 |
| 4,733,818 | 3/1988 | Aghnides | 239/553.3 X |
| 4,791,775 | 12/1988 | Raque et al. | 53/510 |
| 4,905,454 | 3/1990 | Sanfilippo et al. | 53/432 |
| 5,001,878 | 3/1991 | Sanfilippo et al. | 53/510 |
| 5,069,020 | 12/1991 | Sanfilippo et al. | 53/510 |
| 5,228,269 | 7/1993 | Sanfilippo et al. | 53/432 |

FOREIGN PATENT DOCUMENTS

| | | | |
|---|---|---|---|
| 0447131 | 3/1948 | Canada | 141/70 |
| 463300 | 2/1950 | Canada . | |
| 1309992 | 9/1989 | Canada . | |
| 3323710 | 1/1985 | Germany | 53/432 |
| 2139313 | 5/1990 | Japan | 141/64 |

*Primary Examiner*—J. Casimer Jacyna

*Attorney, Agent, or Firm*—Willian Brinks Hofer Gilson & Lione

[57] ABSTRACT

A row of open top containers travelling on a conveyor is purged of oxygen by passing the containers along a gas distribution manifold disposed parallel to the direction of travel of the containers. The manifold includes at least one region of lower flow resistance disposed parallel to the direction of travel, for supplying a higher velocity inert gas flushing stream continuously and at substantially steady state to the containers. The manifold also includes at least one region of higher flow resistance disposed parallel to the direction of travel, for supplying a lower velocity inert gas region along the containers, continuously and at substantially steady state. As the containers pass along the manifold, the inert flushing gas steadily removes oxygen from the containers, while the lower velocity inert gas region prevents the flushing gas from drawing in air.

28 Claims, 4 Drawing Sheets

GAS FLUSHING APPARATUS AND METHOD

FIELD OF THE INVENTION

The invention relates to an improved gas flushing apparatus and method. In particular, this invention relates to an improved apparatus and method for removing oxygen from dry food containers.

BACKGROUND OF THE INVENTION

Various techniques for removing oxygen from dry food containers are known in the art. Such containers are used, for example, for the packaging of nuts, coffee, powdered milk, cheese puffs, and various other dry foods. Typically, these containers are exposed to an inert gas flush and/or vacuum for a period of time, subsequent to filling but prior to sealing. When the oxygen has been substantially removed from the food contents therein, the containers are sealed, with or without vacuum.

A gas flushing apparatus for removing oxygen from food containers is disclosed in U.S. Pat. No. 4,140,159, issued to Domke. A conveyor belt carries the open top containers in a direction of movement directly below a gas flushing device. The gas flushing device supplies inert gas to the containers in two ways. First, a layer or blanket of low velocity flushing gas is supplied to the entire region immediately above and including the open tops of the containers through a distributing plate having a plurality of small openings. Second, each container is purged using a high velocity flushing gas jet supplied through a plurality of larger jet openings arranged side-by-side in a direction perpendicular to the direction of movement of the food containers. As the containers move forward, in the direction of movement, the steps of inert gas blanketing followed by jet flushing can be repeated a number of times until sufficient oxygen has been removed from the containers, and from the food contents therein.

One aspect of the apparatus disclosed in Domke is that the flow of gas in a container is constantly changing. As a container moves past a high velocity jet of flushing gas, the jet is initially directed downwardly into the container at the leading edge of the container open top. As the container moves further forward, the flushing gas is directed into the center and, later, into the trailing edge of the open top, after which the container is no longer exposed to that particular jet. Then, the process is repeated as the container passes below another jet.

Constantly changing jet patterns in prior art devices create turbulence above and within the containers, which can cause surrounding air to be pulled into the containers by the jets as well as removed. This turbulence imposes a limitation on the speed at which the containers pass below the jets. As the containers move faster beneath the jets, the flow patterns within the containers change faster, and the turbulence increases. Also, at high line speeds, purging gas has more difficulty going down into the containers, and a greater tendency to remain in the head space above the containers. Also, a perpendicular arrangement of jets relative to the direction of container travel causes much of the jet to be directed outside the containers, especially when the containers are round.

SUMMARY OF THE INVENTION

The present invention is a gas flushing apparatus and method which substantially reduces the changing gas flow patterns in the containers, significantly reduces turbulence caused by the purge, minimizes the effects of line speed on the turbulence, and permits a steady flow of inert gas to enter the containers causing constant displacement of the gas environment in the containers. A single source of gas is supplied to a manifold located along, and parallel to, a row of open top containers being transported by a conveyor. The manifold has at least two areas of different flow resistance, with one flow resistance being higher than the other.

The area of higher flow resistance imparts a relatively low velocity flow of inert gas to the open tops of the moving containers and forms an inert gas blanket adjacent the container open tops. The lower velocity inert gas can be supplied substantially at steady state so that there is no interruption or significant fluctuation in the inert gas blanket supplied to each container, as the container moves along the manifold. This is accomplished by providing the area of higher flow resistance along the manifold, parallel to the direction of travel of the containers.

The area of lower flow resistance imparts a relatively high flow of inert gas to the open tops of the containers, sufficient to flush residual oxygen out of the containers. The area of lower flow resistance is adjacent the area of higher flow resistance on the manifold and, preferably, is between two areas of higher flow resistance. When arranged in this fashion, the two areas of lower velocity (higher resistance) flow help prevent the area of higher velocity (lower resistance) flow from drawing in outside air. The higher velocity inert gas can also be supplied substantially at steady state so that there is no interruption or significant fluctuation in the inert gas flush supplied to each container, as the container moves along the manifold. This is accomplished by providing the area of lower flow resistance along the manifold, parallel to the direction of travel of the container.

Because the lower flow inert gas blanket and higher flow inert gas flush are supplied without significant interruption even as the containers travel, the flow patterns within the containers remain relatively constant throughout the duration of the containers' travel along the manifold. The flow pattern variation above and within the containers is thereby minimized, causing a corresponding minimization in the surrounding air pulled into the containers by the purge. Furthermore, increased line speeds do not affect the flow patterns within the containers, allowing higher line speeds without compromising the quality of the purge. Also, the tendency of higher velocity purging gas to go down into the containers is not significantly reduced as the line speed is increased. Even greater line speeds can be achieved using longer manifolds or multiple manifolds in series to increase the effective length.

With the foregoing in mind, it is a feature and advantage of the invention to provide a gas purging apparatus and method which achieves dual velocity flow using a single source of gas, a common manifold, and a simple construction, thereby reducing cost and space requirements.

It is also a feature and advantage of the invention to provide a dual velocity gas purging apparatus and method which reduces the inert gas usage to a minimum.

It is also a feature and advantage of the invention to provide a dual velocity gas purging apparatus and method which operates substantially at steady state, without interruption, thereby reducing the tendency of the jet to pull air into the containers from the surrounding atmosphere, and allowing a steady flow of inert gas into the containers, causing a constant net outflow of residual air.

It is also a feature and advantage of the invention to provide a dual velocity gas purging apparatus and method which permits a significant increase in line speeds without compromising the quality of the purge.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
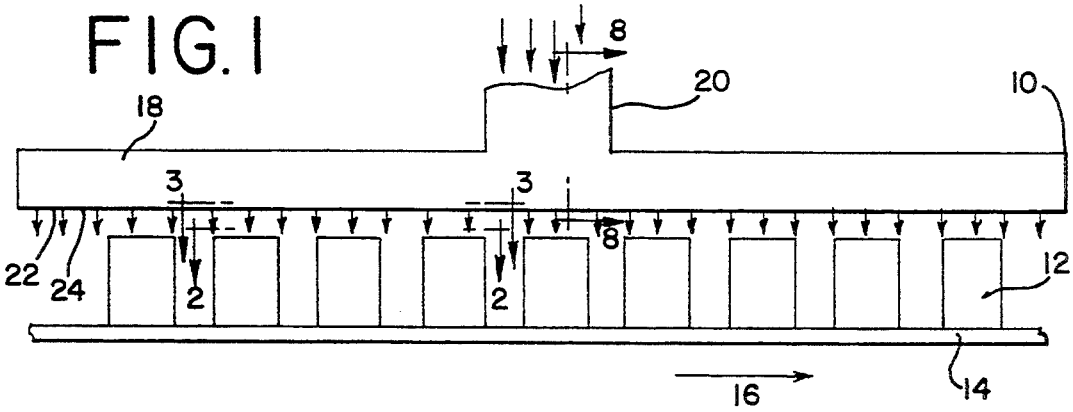
FIG. 1 is a side view of a gas purging apparatus of the invention, longitudinally disposed above a row of open-top containers being transported by a conveyor.
Figure 2:
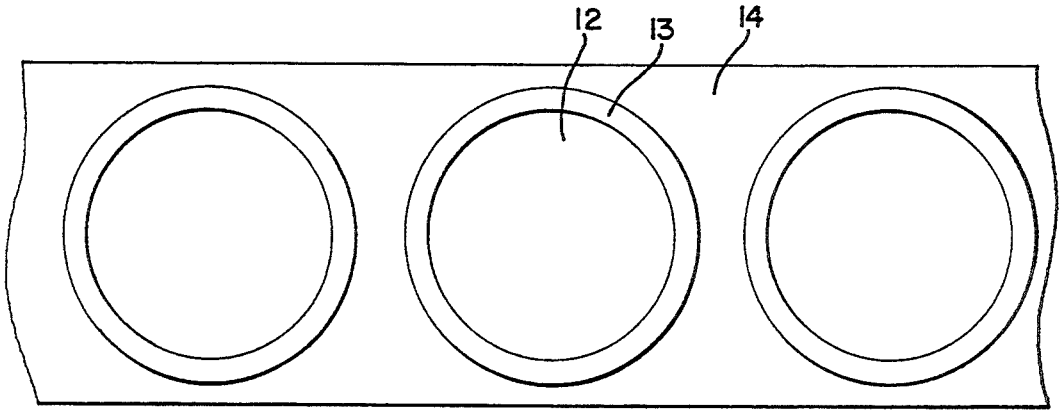
FIG. 2 is taken along the line 2—2 in FIG. 1 and shows the containers and the conveyor from the top.
Figure 3:
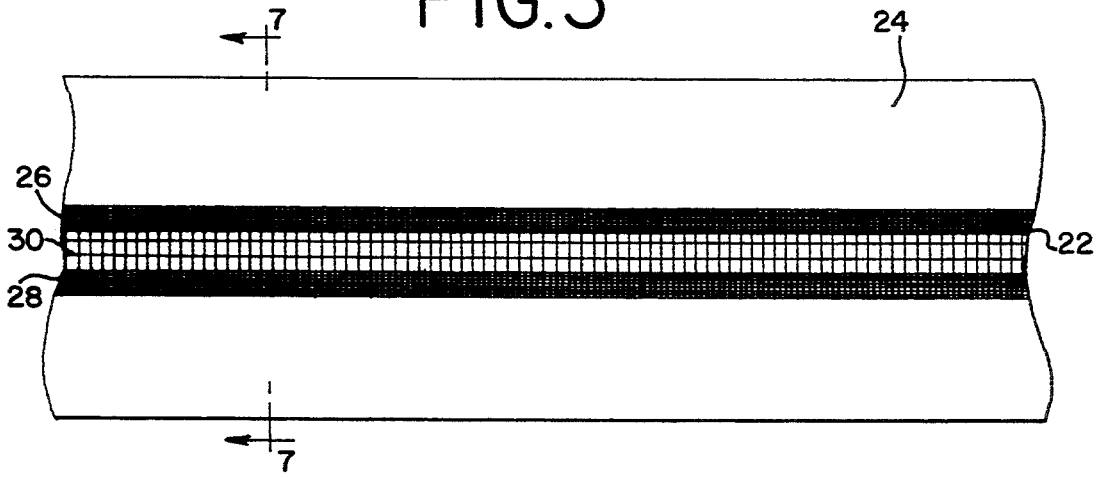
FIG. 3 is a sectional view of the apparatus of FIG. 1, taken along the line 3—3 in FIG. 1 and showing the gas distribution manifold.

Referring to FIGS. 1—3, a gas purging apparatus 10 of the invention is disposed along and above a row of open-top containers 12 traveling on a conveyor 14 along the apparatus 10 in a direction of travel designated by arrow 16. The gas purging apparatus 10 includes a longitudinal chamber 18 having an inlet 20 for receiving inert gas from a single source (not shown) and a distribution manifold 22 for distributing inert gas to the open top containers. The distribution manifold 22 is located on a bottom surface 24 of the chamber 18, longitudinally oriented with respect to the chamber 18, parallel to the conveyor 12 and parallel to the direction of travel 16 of the containers 12.

The vertical distance between the manifold 22 and the tops 13 of the open top containers 12 is small, and should not exceed about 0.375 inches for the embodiment of FIGS. 1—3. Preferably, this vertical distance is between about 0.125 and about 0.250 inches, most preferably between about 0.175 and about 0.200 inches. In the embodiment of FIGS. 1—3, the chamber 18 has a height of about 1.0 inch, a length of about 4 feet, and a width of about 4.0 inches. Each of the containers 12 has a height of about 7.5 inches and a diameter of about 3.5 inches. The inert gas has an inlet and an outlet flow rate of about 2 to about 15 cubic feet per minute, for this embodiment. The optimum inert gas flow rate will vary depending on the lines speed and container dimensions.

Preferably, the chamber 18 is closed except for the inert gas inlet 20 and the distribution manifold 22. The chamber 18 may be rectangular as shown in FIG. 1, and may be constructed of stainless steel, aluminum, rigid plastic or any other rigid material. The chamber 18 should preferably be at least as wide, and more preferably somewhat wider, than the diameters of the open top containers 12. The length of the chamber 18 may vary depending on the desired line speed and minimum residence time underneath the chamber 18 for each container 12. Also, a plurality of chambers 18 may be arranged lengthwise in series to create a higher "effective" length. For a given residence time, the maximum line speed increases as the length of the chamber 18 is increased. For the embodiment described above, the preferred line speed is about 250 containers per minute (145 feet per minute of conveyor) and requires approximately 12 feet of effective chamber length.

Referring to FIG. 3, the preferred distribution manifold 22 includes a longitudinally oriented center area 30 of lower flow resistance in between and adjacent to two smaller longitudinally oriented areas 26 and 28 of higher flow resistance. Each of the flow regions 26, 28 and 30 extends the length of the bottom surface 24 of the chamber 18, is positioned above the open tops 13 of containers 12, and is oriented parallel to the direction of travel 16 of containers 12. In the preferred embodiment, the overall width of the distribution manifold 22 is smaller than the width of the bottom surface 24, and the diameter of the containers 12, with the remainder of the bottom surface 24 being closed. This not only reduces inert gas quantities and costs but also improves the quality of the purge by providing a very desirable flow pattern, discussed below.

In the embodiment shown in FIG. 3, for instance, the bottom surface 24 of the chamber 18 may have a width of about 4.0 inches as described above. The manifold 22, by comparison, may have an overall width of about one inch for containers having opening diameters of about 4–6 inches. The central region 30 of lower flow resistance may have a width of about 0.5 inch, and the surrounding regions 26 and 28 of higher flow resistance may each have a width of about 0.25 inch. Smaller containers may utilize smaller optimum manifold widths. For containers having opening diameters of about 2–3 inches, the manifold may have an overall width of 0.5 inches, with correspondingly smaller widths for the regions of higher and lower flow resistance.

Figure 7:
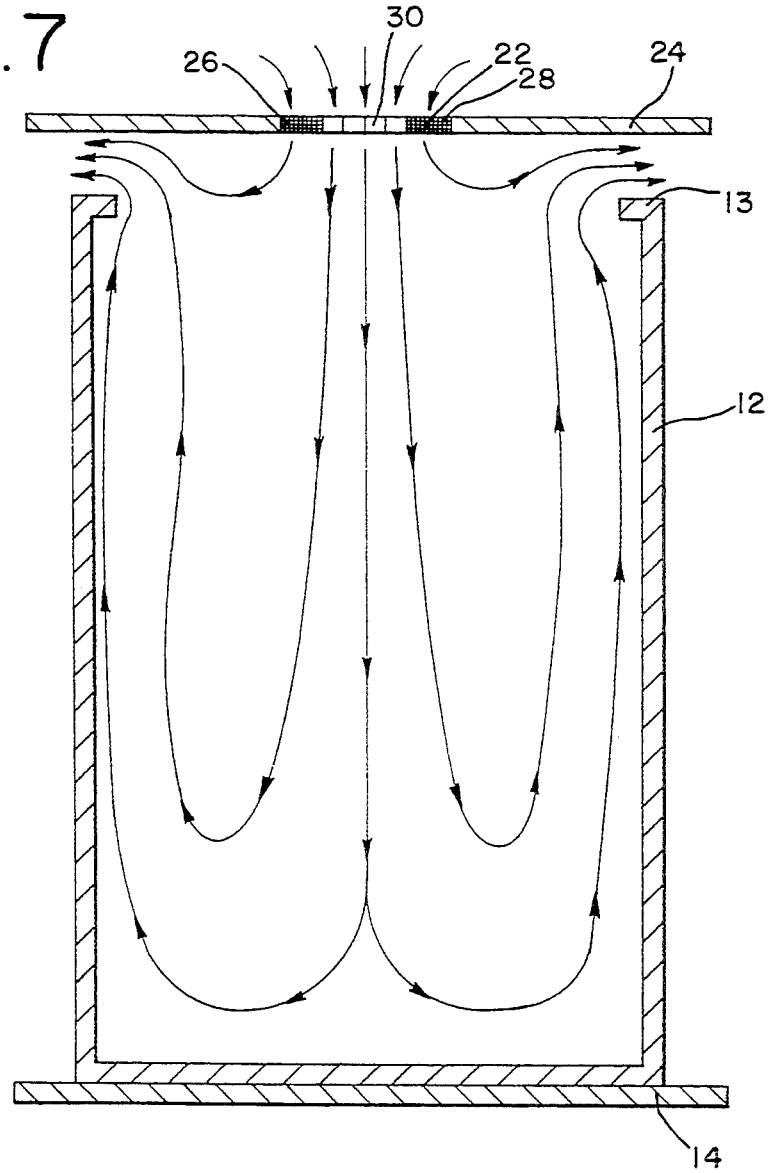
FIG. 7 is a front sectional view of a single container being purged, taken along line 7—7 in FIG. 3.

Preferably, the distribution manifold 22 is positioned longitudinally in the center of the bottom surface 24 and exactly over the centers of moving containers 12 as shown in FIG. 7. Inert gas passing through the center area 30 of lower flow resistance has a relatively high velocity, sufficient to carry the gas to the bottom of each container 12, then up and out as shown by the arrows. Inert gas passing through adjacent regions 26 and 28 of higher flow resistance may be partially carried into the containers 12 by a "venturi" effect from the higher velocity gas. Otherwise, the gas passing through areas 26 and 28 has a lower velocity, and creates an inert gas blanket covering the tops of containers 12. This inert gas blanket surrounds the higher velocity inert gas jet passing from the region 30 on both sides, protecting the higher velocity jet from mixing with surrounding air.

As shown in FIG. 7, the flow patterns caused by injecting the higher velocity inert gas centrally through region 30 of manifold 22, act in cooperation with the inert gas blanket originating from regions 26 and 28 of manifold 22, to cause a strong positive outflow of inert gas (and any oxygen from the container carried with it) through the space between the surface 24 of chamber 18 and the rims 13 of containers 12. Because the regions 26, 28 and 30 are oriented parallel to the direction of travel of the containers 12, the gas flow patterns (including the outflow) exist continuously and substantially at steady state for the entire time that each container 12 remains underneath the surface 24 of chamber 18. Therefore, there is no opportunity for oxygen to enter the containers 12 from the outside. The oxygen content inside the containers 12 steadily decreases as each container moves below the manifold 22 until the oxygen content is reduced to target levels or below, whereby the purging is completed.

The regions 26, 28 and 30 of high and low flow resistance can be created using adjacent welded screens of different opening size (FIG. 8), selectively layered screens (FIG. 11), porous plastic (e.g. porous high molecular weight high density polyethylene), porous plates, or any selectively porous material that acts as a diffuser. In the embodiment shown in FIG. 8, the 0.5-inch wide center region 30 can be formed of a two-ply wire screen having a hole size of 80 microns, with 0.25-inch wide, 3-inch long slots formed in the center parallel to the direction of container travel. The slots can be spaced about 0.75 inch apart from each other, similar to the slots 37 in FIG. 4. This center region 30 can be welded to adjacent regions 26 and 28, each 0.25 inch wide, each being formed from a five-ply wire screen having a hole size of 40–100 microns. As explained above, this particular manifold 22, having a total width of 1.0 inch, is more suitable for flushing wider containers having opening diameters of 4–6 inches.

Figure 11:
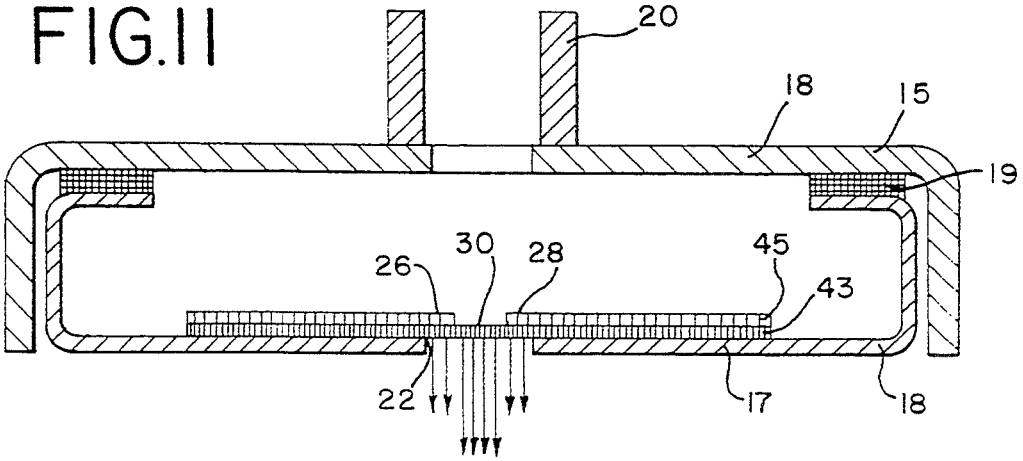
FIG. 11 is a second alternative embodiment of the distribution chamber shown in FIG. 8.

In the embodiment shown in FIG. 11, the screens are selectively layered to form a 0.25-inch wide center region 30 of lower flow resistance and adjacent regions 26 and 28 of higher flow resistance, each of the regions 26 and 28 having a width of 0.125-inch. As explained above, this particular manifold 22, having a total width of 0.5 inches, is most suitable for flushing narrower containers having opening diameters of 2–3 inches. A lower layer 43 of screen can be formed from a two-ply wire screen having an opening size of 80 microns. An upper layer 45 of screen can be formed from a five-ply wire screen having an opening size of 40–100 microns. The screen layers 43 and 45 cooperate in the regions 26 and 28 to cause the higher flow resistance. In the region 30 of lower flow resistance, only the screen layer 43 operates, with the layer 45 being broken as shown. Alternatively, the layer 45 may be formed with slots, similar to the slots 37 of FIG. 4, in the region 30.

Figure 9:
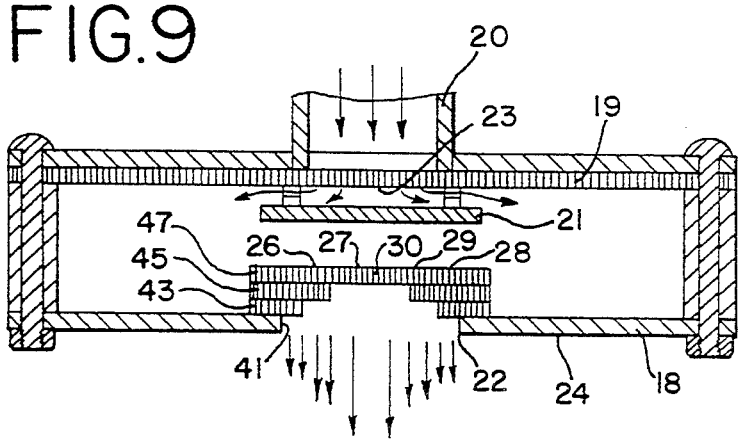
FIG. 9 is an alternative embodiment of the distribution chamber shown in FIG. 8, showing three areas of different flow resistance.
Figure 10:
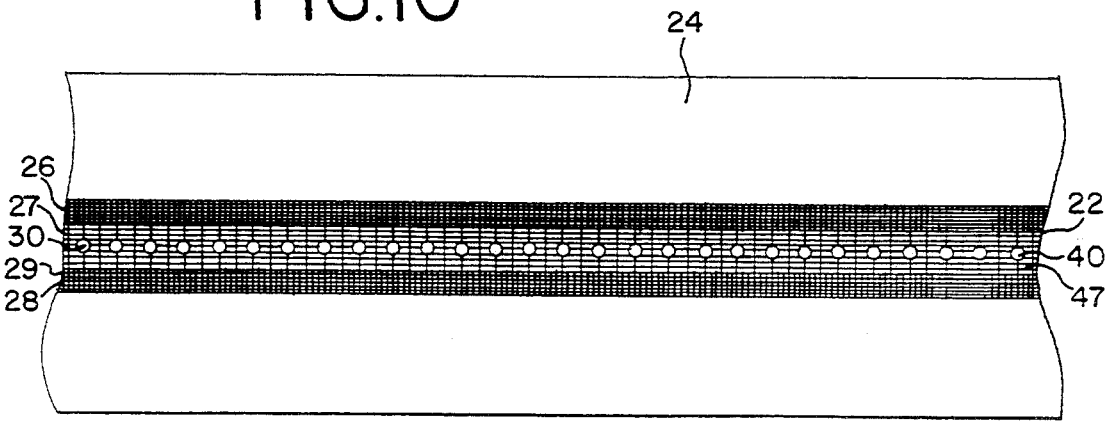
FIG. 10 is an improved manifold having three areas of different flow resistance, corresponding to FIG. 9.

FIGS. 9 and 10 illustrate an embodiment in which an area 30 of higher flow resistance, oriented parallel to the direction of container travel, is between two similarly oriented regions 27 and 29 of intermediate flow resistance. The regions 27 and 29 are also bounded by two similarly oriented regions 26 and 28 of lower flow resistance. This embodiment provides even better protection of the higher velocity jet passing through the region 30, from exposure to surrounding air. This embodiment is particularly useful for purging tall containers.

Referring to FIG. 9, the areas 26 and 28 of higher flow resistance are each formed by layering three screen segments 43, 45 and 47 on top of each other. The screen segments can be joined together and to bottom plate 41 by sintering. The regions 26 and 28 of higher flow resistance involve cooperation between portions of screen layers 43, 45 and 47, without influence from the larger openings 40 in layer 47 (FIG. 10).

The region 30 of lower flow resistance, by comparison, includes only a single layer 47 of relatively open screen, with a row of circular openings 40 therein (FIG. 10), oriented parallel to the direction of container travel. The regions 27 and 29 of intermediate flow resistance are formed by portions of the screen layers 45 and 47 acting in cooperation, without the screen layer 43, and without influence from openings 40 in the layer 47.

Figure 8:
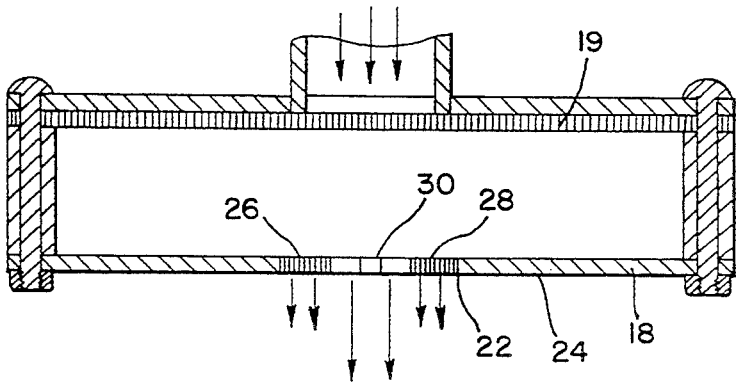
FIG. 8 is a sectional view of a distribution chamber, taken along line 8—8 in FIG. 1.

As exemplified in FIGS. 8, 9 and 11, many different embodiments of the chamber 18 can be employed. FIG. 8 illustrates the use of a screen diffuser 19 below the inlet 20, to help diffuse gas entering the chamber 18. FIG. 9 illustrates the use of both a screen diffuser 19 and a solid plate 21 below the inlet 20, to direct inert gas to the left and right of the inlet 20 as shown by the arrows. Porous media 23 can be installed between the plate 21 and screen diffuser 19 to assist in this lateral diffusion. FIG. 11 (focusing on narrower containers and the use of smaller chamber 18 and manifold 22) does not illustrate the use of a diffusing mechanism below the inlet 20. In FIG, 11, the chamber 18 is formed from a primarily two-piece construction. The wider steel top piece 15 and slightly narrower steel bottom piece 17 are joined using gaskets 19, preferably of polyurethane foam, to prevent leakage between the two pieces.

Figure 4:
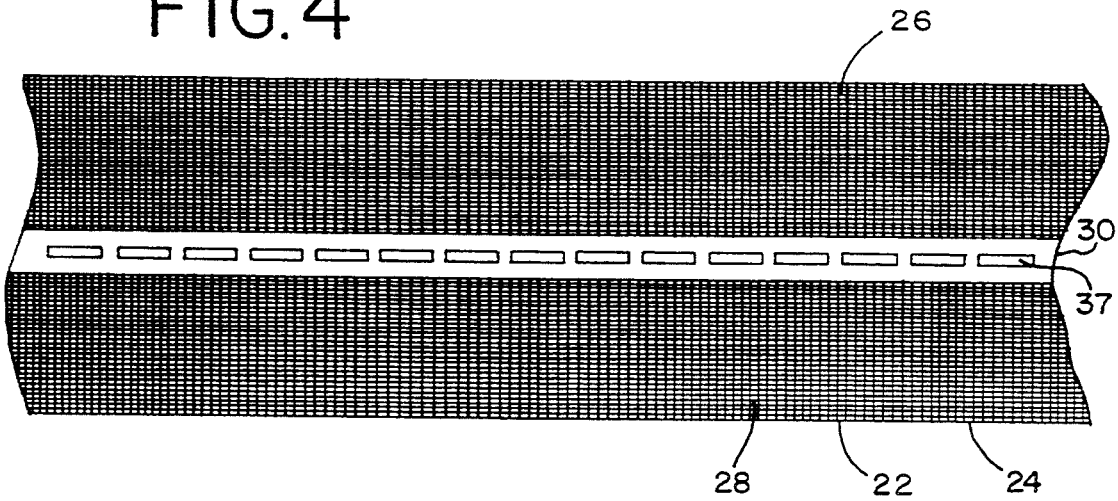
FIG. 4 is an alternative embodiment of the manifold shown in FIG. 3.
Figure 5:
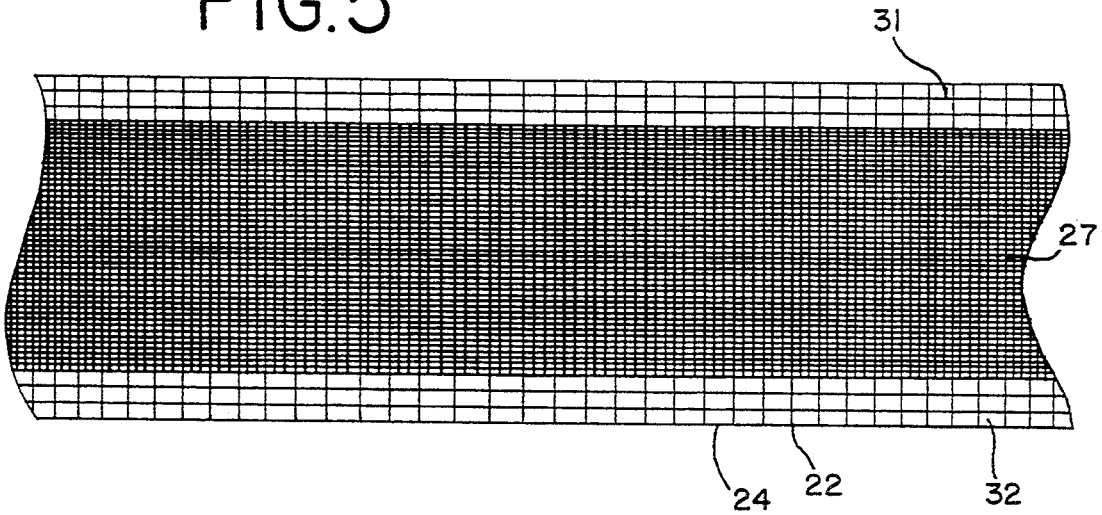
FIG. 5 is a second alternative embodiment of the manifold shown in FIG. 3.
Figure 6:
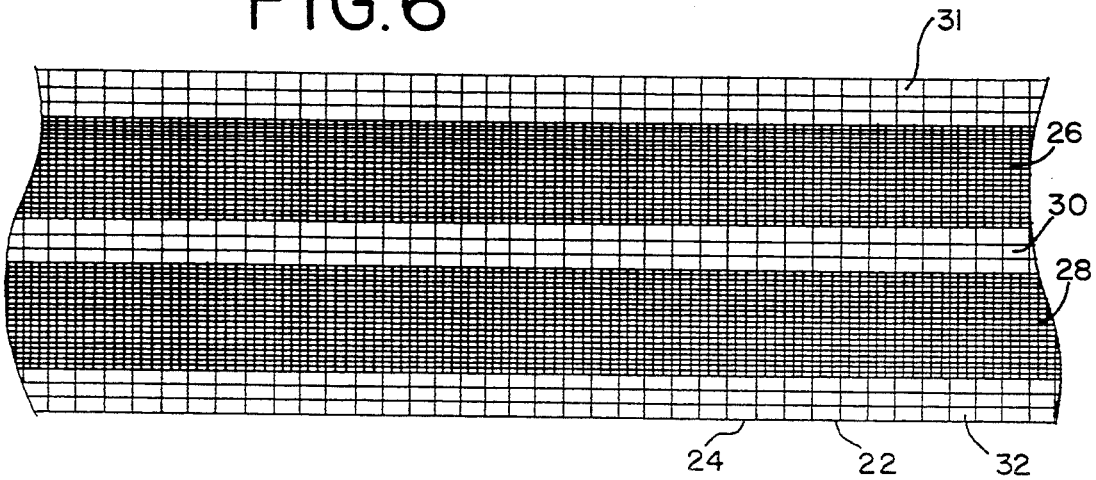
FIG. 6 is a third alternative embodiment of the manifold shown in FIG. 3.

FIGS. 4 and 5 and 6 each illustrate different embodiments of a distribution manifold 22. In FIG. 4, the areas 26 and 28 of higher flow resistance are much wider than the area 30 of lower flow resistance and the manifold 22 constitutes the entire bottom 24 of the chamber 18. Also, the area 30 of lower flow resistance is formed from a perforated plate instead of a screen, with the slots 37 being oriented parallel to the direction of container travel. Compared to FIG. 3, a higher proportion of inert gas from the source 20 would be used to form the blanket, and a correspondingly lower proportion would be used for purging, if the manifold 22 of FIG. 4 were employed. The embodiment of FIG. 4 might be used for flushing wide, shallow containers which have less need for a deep, high velocity flush than the container 22 shown in FIG. 7.

FIG. 5 illustrates an embodiment of the manifold 22 having a large area 27 of higher flow resistance in the center and two smaller areas 31 and 32 of lower flow resistance along the sides. This embodiment can be used for special applications requiring protection from outside drafts or breezes, such as might be caused by machinery with moving parts. The inert gas blanket is formed by lower velocity inert gas passing through the high resistance flow region 27, and is protected from mixing with outside air by the higher velocity inert gas passing through low resistance flow regions 31 and 32.

FIG. 6 illustrates an embodiment which combines the features shown in FIGS. 4 and 5. A center region 30 of lower flow resistance, used for purging, is bounded by two adjacent regions 26 and 28 of higher flow resistance, used to form an inert gas blanket. The regions 26 and 28 are also bounded by two adjacent outside regions 31 and 32 of lower flow resistance, which protect the inert gas blanket from exposure to outside air.

All of the foregoing embodiments of the distribution manifold 22 have in common the features of a higher resistance (lower velocity) distribution region and an adjacent lower resistance (higher velocity) flow region disposed longitudinally above the open-top containers 22, each parallel to the direction 16 of container movement, each extending substantially the length of manifold 22, which create and maintain uniform gas flow patterns within the containers 22 passing beneath the chamber 18. All of the foregoing embodiments further have in common the use of a single, integrated distribution manifold 22, in at least one single distribution chamber 18, and a single source of inert gas, to create and maintain dual velocity inert gas flow. It is also possible to use multiple distribution chambers 18 in series, and/or multiple inert gas sources, to improve gas distribution within each chamber 18 and to make fabrication easier.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. An apparatus for flushing oxygen from containers moving along the apparatus, comprising:

a distribution chamber having a length, width and height;

an inlet in the distribution chamber for receiving inert gas from a source; and a distribution manifold in the distribution chamber including at least one longitudinally oriented region of higher flow resistance and at least one longitudinally oriented region of lower flow resistance, said lower flow resistance region and higher flow resistance region being parallel to each other and parallel to the direction of movement of the containers for allowing inert gas from both regions to be simultaneously directed downward into the containers.

2. The apparatus of claim 1, wherein the distribution manifold is narrower than the width of the distribution chamber.

3. The apparatus of claim 1, wherein the distribution manifold comprises two longitudinally oriented regions of higher flow resistance and a longitudinally oriented region of lower flow resistance between the regions of higher flow resistance.

4. The apparatus of claim 1, wherein the distribution manifold comprises one or more wire mesh screens.

5. The apparatus of claim 4, wherein the screens are selectively layered to form the regions of higher and lower flow resistance.

6. The apparatus of claim 4, wherein the screens have different mesh sizes corresponding to the regions of higher and lower flow resistance.

7. The apparatus of claim 1, wherein the distribution manifold comprises a porous plastic material.

8. The apparatus of claim 1, wherein the distribution manifold comprises a perforated plate.

9. The apparatus of claim 1, wherein the regions of higher flow resistance and lower flow resistance are adjacent to each other.

10. The apparatus of claim 1, comprising a plurality of distribution chambers arranged in series.

11. A system for flushing oxygen from containers, comprising:

a conveyor for transporting the containers in a direction of travel;

a gas distribution device along the conveyor including an inlet for receiving inert gas and a manifold for distributing inert gas to the containers;

a region of lower flow resistance in the manifold, oriented parallel to the direction of travel, for distributing higher velocity inert gas; and a region of higher flow resistance in the manifold, oriented parallel to the direction of travel and to the region of lower flow resistance, for distributing a lower velocity inert gas blanket along the containers, said lower velocity inert gas blanket and said higher velocity inert gas blanket being simultaneously directed vertically downward into the containers.

12. The system of claim 11, wherein the manifold comprises two of the regions of higher flow resistance and one of the regions of lower flow resistance between the regions of higher flow resistance.

13. The system of claim 11, wherein the manifold comprises two of the regions of lower flow resistance and one of the regions of higher flow resistance between the regions of lower flow resistance.

14. The system of claim 11, wherein the manifold comprises three of the regions of lower flow resistance alternating with two of the regions of higher flow resistance.

15. The apparatus of claim 11, wherein the distribution manifold comprises the region of lower flow resistance, two regions of intermediate flow resistance surrounding the region of lower flow resistance, and two of the regions of higher flow resistance adjacent to the areas of intermediate flow resistance.

16. The system of claim 11, wherein the distribution manifold comprises one or more wire mesh screens configured to form the regions of higher and lower flow resistance.

17. The system of claim 11, wherein the distribution manifold comprises a porous plastic material.

18. The system of claim 11, wherein the regions of higher flow resistance and lower flow resistance are adjacent to each other.

19. The system of claim 18 wherein the resistance regions of the manifold are graduated from a low flow resistance region in a middle region of the manifold to increasingly higher flow resistance regions extending outwards from the middle region.

20. A method of flushing oxygen from containers with open tops, moving on a conveyor in a direction of travel, comprising the steps of:

providing a gas distribution manifold positioned along the conveyor;

passing the containers along the gas distribution manifold for a period of time;

supplying a higher velocity stream of inert gas flush through the gas distribution manifold and into the containers through the open tops, through a region of lower flow resistance oriented parallel to the direction of travel, while the containers are along the gas distribution manifold; and supplying a stream of lower velocity inert gas blanket through the gas distribution manifold and along the open tops of the containers, through a region of higher flow resistance oriented parallel to the direction of travel and to the region of lower flow resistance, while the containers are along the gas distribution manifold, said lower velocity stream and said higher velocity stream being simultaneously directed downward into the containers .

21. The method of claim 20, further comprising the step of supplying a single source of inert gas to the gas distribution manifold.

22. The method of claim 20, wherein the higher velocity stream of inert gas is supplied continuously and at substantially steady state.

23. The method of claim 20, wherein the lower velocity stream of inert gas is supplied continuously and at substantially steady state.

24. The method of claim 20, further comprising the step of supplying a second stream of lower velocity inert gas blanket through the gas distribution device through a second region of higher flow resistance oriented parallel to the direction of travel, while the containers are along the gas distribution manifold.

25. The method of claim 24, wherein the higher velocity and lower velocity inert gas streams are supplied through adjacent locations in the manifold.

26. The method of claim 24, wherein the higher velocity inert gas stream is supplied through the manifold at a location between the two lower velocity inert gas streams.

27. The method of claim 20, wherein the higher velocity and lower velocity inert gas streams are supplied through adjacent locations in the manifold.

28. The method of claim 20 wherein the streams of inert gas are graduated from a higher velocity stream in a middle region of the manifold to increasingly lower velocity streams extending outwards from the middle region.

* * * * *